US006314277B1

(12) United States Patent
Hsu et al.

(10) Patent No.: US 6,314,277 B1
(45) Date of Patent: Nov. 6, 2001

(54) ELECTROMAGNETIC RADIATION PROTECTION DEVICE OF A MOBILE PHONE

(76) Inventors: Yuan-Fang Hsu; Chin-Tong Liu, both of No. 20, Lane496, Nou-Pu South Rd., Hsinchu City (TW)

( * ) Notice: Subject to any disclaimer, the term of this patent is extended or adjusted under 35 U.S.C. 154(b) by 0 days.

(21) Appl. No.: 09/347,053

(22) Filed: Jul. 2, 1999

(51) Int. Cl.[7] ..... H01Q 11/12
(52) U.S. Cl. ..... 455/117; 455/129; 455/90
(58) Field of Search ..... 455/90, 575, 129, 455/117, 550; 343/702

(56) References Cited

U.S. PATENT DOCUMENTS 5,999,142 * 12/1999 Jang ..... 343/834
6,052,567 * 4/2000 Ito et al. ..... 455/90
6,095,820 * 8/2000 Luxon et al. ..... 434/702
6,137,998 * 10/2000 Holshouser et al. ..... 455/129
6,184,835 * 2/2001 Chen et al. ..... 343/702

* cited by examiner

*Primary Examiner*—Nguyen T. Vo
*Assistant Examiner*—N. Mehrpour

(57) ABSTRACT

An electromagnetic radiation protection device of a mobile phone installed at one side of an antenna of a mobile phone. The device comprises an electromagnetic wave absorbing piece, a dielectric plate, an electronic joint loop, a negative electrode lead, etc. The electromagnetic wave absorbing piece serves to absorb the electromagnetic wave toward the user's head. Then the electromagnetic wave irradiates to the negative electrode lead of a power source through the electronic joint loop and the negative electrode lead. Thereby, the electromagnetic radiation from the mobile phone to user's head will be reduced effectively, and the threat of brain harm is also reduced.

3 Claims, 4 Drawing Sheets

ELECTROMAGNETIC RADIATION PROTECTION DEVICE OF A MOBILE PHONE

BACKGROUND OF THE INVENTION

In current communication world, those controlling the communication technology will become a winner of current information world. Thus, communication devices have become necessary equipment. Since mobile phones are more and more popular, almost everybody has one. However, with the increment of communication traffic, electromagnetic radiation is also filled in the air. But this is harmful to the human body. Especially, the electromagnetic radiation from the mobile phone of user himself (herself) because the radiation from user's mobile phone is very near the body of user, especially the brain.

The current mobile phone system has been advanced to digital mobile phones from early analog mobile phones, the frequency band ranges from 800 MHz to 1000 MHz, recently, 1800 MHz frequency is also included. Such high frequency electromagnetic radiation has a great transmission property. When the mobile phone with a power of 0.5 watt is emitted, it the mobile phone is near the neck portion of user, about 0.2 watt of power will penetrate through the head of the user and is probably produced a bad effect.

SUMMARY OF THE INVENTION

Accordingly, the primary object of the present invention is to provide an electromagnetic radiation protection device of a mobile phone installed at one side of an antenna of a mobile phone, thereby 80% of electromagnetic radiation is absorbed, therefore the sub-effect of the mobile phone is reduced greatly.

Another object of the present invention is to provide an electromagnetic radiation protection device of a mobile phone installed at one side of an antenna of a mobile phone. The device comprises an electromagnetic wave absorbing piece, a dielectric plate, an electronic joint loop, a negative electrode lead, etc. The electromagnetic wave absorbing piece serves to absorb the electromagnetic wave toward the user's head. Then the electromagnetic wave irradiates to the negative electrode lead of a power source through the electronic joint loop and the negative electrode lead.

A further object of the present invention is to provide an electromagnetic radiation protection device of a mobile phone, which may be assembled and used easily and is effective for isolating the electromagnetic radiation of a mobile phone. The device is formed simply by a plurality of metal pieces, plastic piece, and electronic circuit.

The various objects and advantages of the present invention will be more readily understood from the following detailed description when read in conjunction with the appended drawing.

DETAILED DESCRIPTION OF THE PREFERRED EMBODIMENTS

Figure 1:
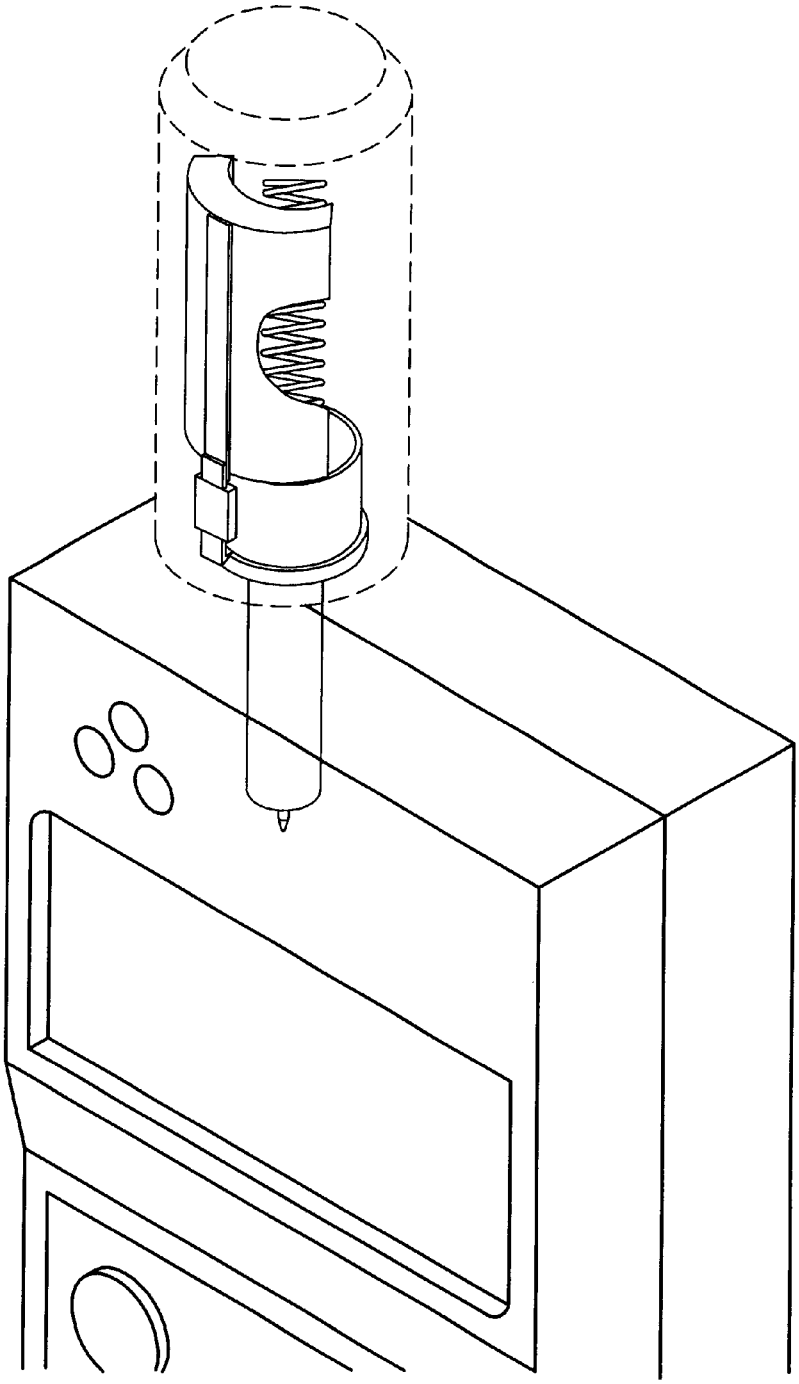
FIG. 1 shows the use of the present invention.
Figure 2:
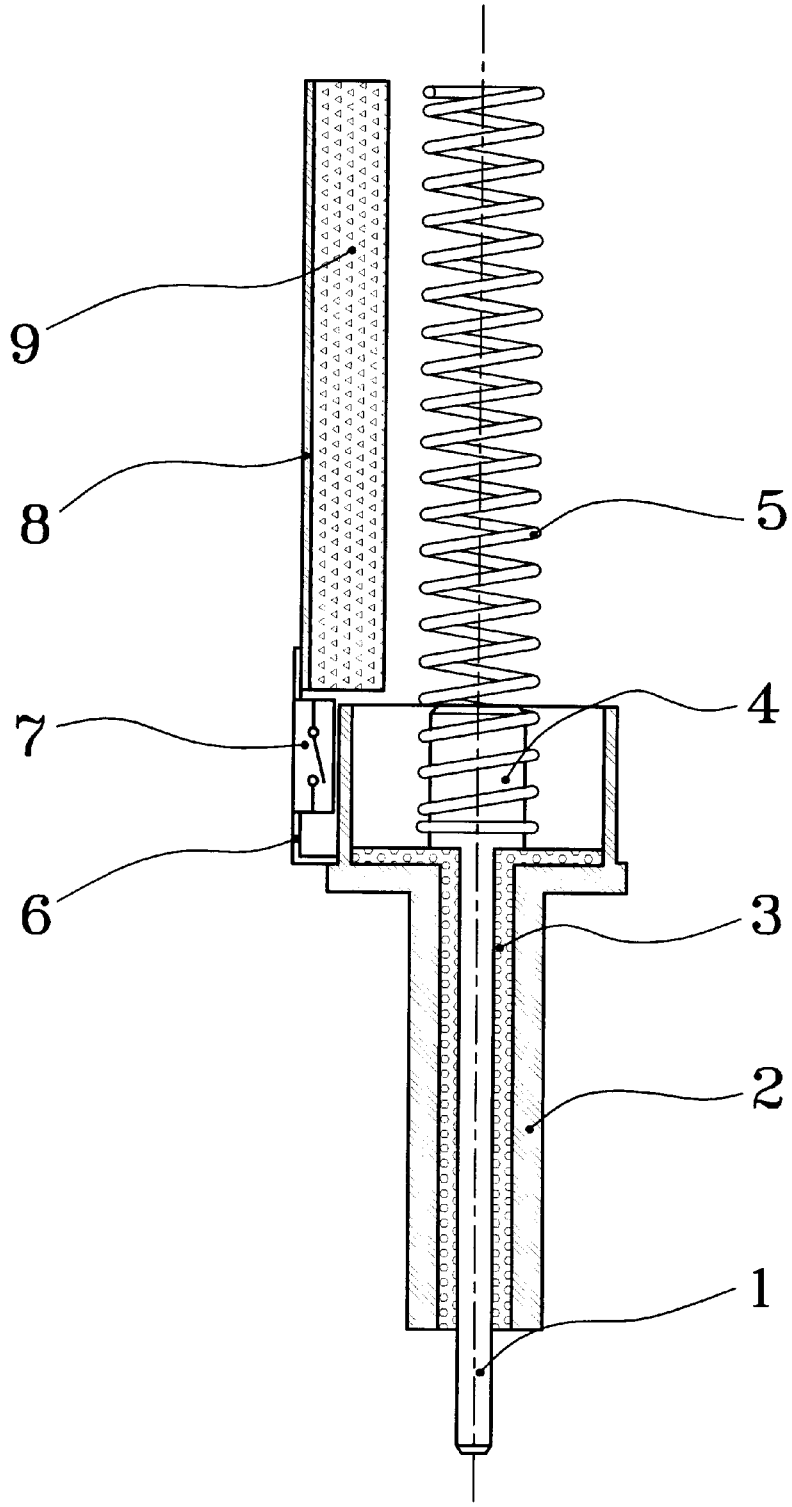
FIG. 2 is a cross sectional view of the present invention.
Figure 3:
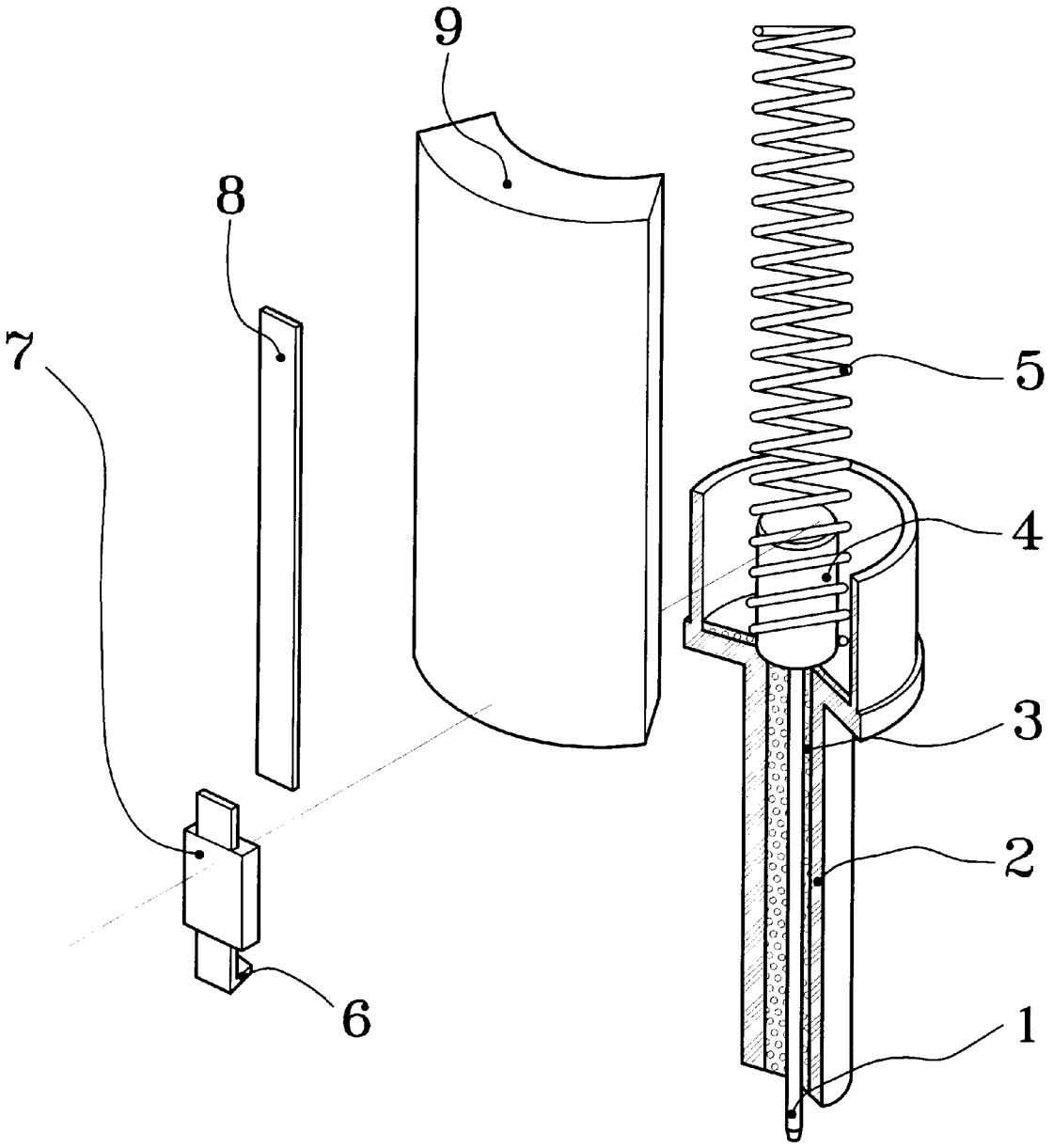
FIG. 3 is an exploded view of the present invention.
Figure 4:
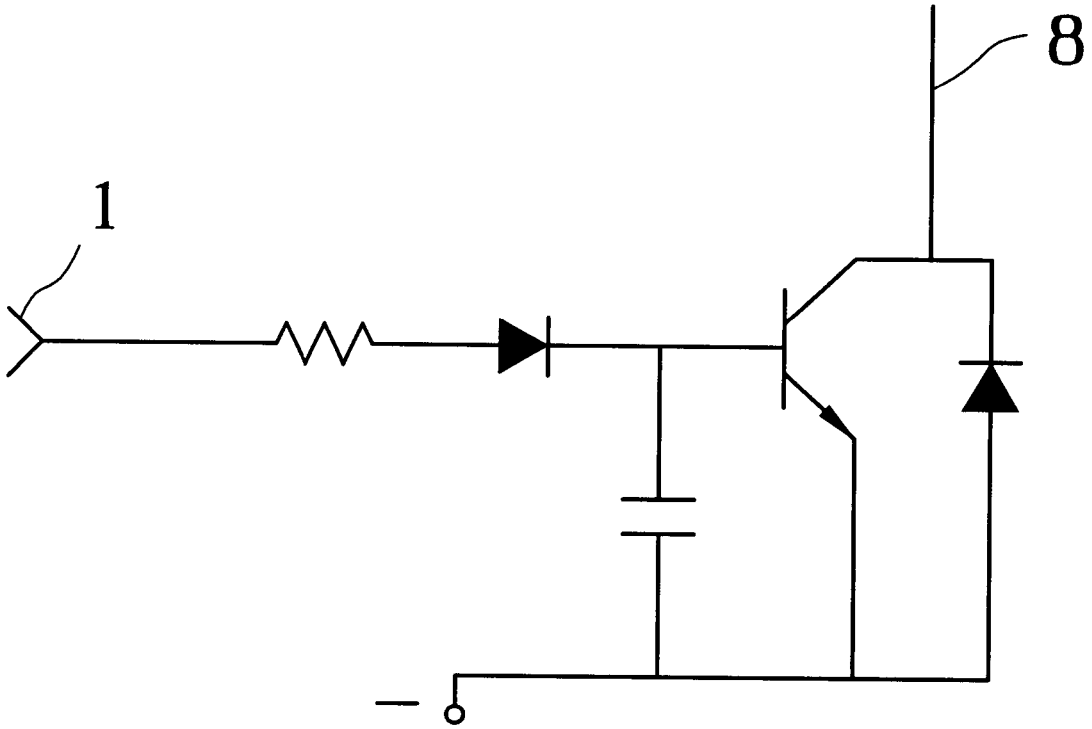
FIG. 4 shows the electronic joint loop of the present invention.

As shown in FIGS. 1, 2 and 3, the present invention is formed by an electromagnetic wave absorbing piece 8, a dielectric plate 9, an electronic joint loop 7, a negative electrode lead 6, etc. The whole structure is further packaged with the signaling joint 1, antenna fixture 2 (negative electrode), an insulating cover of the signaling joint 3, an antenna joint 3, an antenna joint 4, a helical antenna 5, etc of the antenna structure by plastic or rubber filling. The electromagnetic wave absorbing piece 8 is installed at the side near the helical antenna 5. The dielectric plate 9 serves to isolate the electromagnetic wave absorbing piece 8 and the helical antenna 5. The lower end of the electromagnetic wave absorbing piece 8 is connected to the input of the joint of the electronic joint loop 7. The output of the joint of the electronic joint loop 7 is connected to the negative electrode lead 6. Another end of the negative electrode lead 6 is connected to the negative electrode of the power source of a mobile phone (such as the antenna fixing seat (2)). In practical using, the original antenna structure is still a preferred embodiment and is convenient in using. Although it is not embodied by the antenna, the present invention can be used at the periphery of the antenna for achieving the predict effect.

When the mobile phone is in using, the signal is carried by electromagnetic wave and thus is sent by the antenna. This signal electromagnetic wave is energetic and transmitted, that is so called electromagnetic radiation. The emission of the electromagnetic radiation is omnidirectionary around the cylinder of the antenna as a center. The strength of the electromagnetic radiation is decreased with the square of the distance to the antenna. When the mobile phone is near the ear, it is apparently that the head of the user is within the range of the electromagnetic radiation.

In the present invention, an electromagnetic wave absorbing piece 8 serves to absorb the electromagnetic wave radiating toward the head. The material of the electromagnetic wave absorbing piece may be a metal and located at the neck of the user in the same side of the antenna 5.

The object of the dielectric plate 9 serves to avoid the directly contact of the electromagnetic wave absorbing piece 8 and the helical antenna 5. Thus, the electromagnetic wave absorbing piece 8 is assured to perform the function of absorption. The material of the dielectric plate 9 is plastic or other material. The width of the material of the dielectric plate 9 will effect the absorption efficiency of the electromagnetic wave absorbing piece 8. The wider the width, the lower the absorption efficiency. While the absorbing radiation energy will irradiate to the negative electrode of the power source system through the negative electrode lead 6.

If the electromagnetic wave absorbed by the electromagnetic wave absorbing piece 8 is not be cancelled, one half of the electromagnetic wave will be reflected toward the direction of the antenna. While another one half will transfer toward the head of the user. Thus, the received electromagnetic wave is necessary to be cancelled. The way for canceling the electromagnetic wave is that the electronic joint loop 7 is connected to the negative electrode lead 6, then the electromagnetic wave is converted as a current to flow to the negative electrode of the power source so as to be cancelled. One end of the negative electrode lead 6 is connected to the output of the electronic joint loop 7, while another end thereof is connected to the negative electrode of the power source system of a mobile phone. The power source system may be circularly around the antenna fixing seat 2. The electromagnetic wave absorbing piece absorbed by the electromagnetic wave absorbing piece 8 is converted as current by the negative electrode lead 6 and then flow to the negative electrode of the power source for canceling, then the electromagnetic wave toward user's head is canceled and therefore the harm to the user is reduced to a minimum.

The electronic joint loop 7 is combined to an electronic (or mechanic) joint through a signal driver. The signal driver receives the signal from the signaling joint for switching over the electronic (or mechanic) joint. Namely, in standby, the antenna severs to receive signal, thus the signal is as small as not to drive a signal, then the electronic (or mechanic) joint is opened. Now, the electromagnetic wave absorbing piece 8 has no any effect. While as a ring is actuated or in speaking, the antenna is in an emitting state, a larger signal will be sent from the signaling joint 1 to the antenna for emitting. The signal is large enough to drive the signal driver and force the electronic (or mechanic) joint to close. Now, the electromagnetic wave absorbing piece 8 will act. Namely, the radiating energy absorbed by the electromagnetic wave absorbing piece 8 will be transferred to the negative electrode of the power source through the joint so that the electromagnetic radiation is reduced properly and the harm to human brain is decreased.

The advantages of the present invention will now described in the following:

1. The electromagnetic radiation from the conventional antenna to the head of the user will be decreased greatly.
2. In dial the handset and in standby condition, the receiving signal in the head of user is approximately equal to that of the conventional one.
3. The transceiver of the original user is unnecessary to add any extra devices. It is only needed to update the original antenna to the antenna of the present invention. Even the transceiver is assembled with the antenna of the present invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An electromagnetic radiation protection device of a mobile phone installed at one side of an antenna of a mobile phone, characterized in that:

the device comprises an electromagnetic wave absorbing piece, a dielectric plate, an electronic joint loop, a negative electrode lead, the electromagnetic wave absorbing piece is installed at the side near said antenna, said dielectric plate serves to isolate said electromagnetic wave absorbing piece and said antenna, a lower end of said electromagnetic wave absorbing piece is structure to an input of a joint of said electronic joint loop, an output of the joint of said electronic joint loop is connected to said negative electrode lead, another end of said negative electrode lead is connected to said negative electrode of the power source of a mobile phone;

in practical using, the electromagnetic radiation from the mobile phone to user's head will be reduced effectively, and the threaten of brain harm is also reduced.

2. The electromagnetic radiation protection device of a mobile phone as claimed in claim 1, wherein said antenna includes a signaling joint, an antenna fixture, an insulating cover of the signaling joint, an antenna joint, an antenna joint, a helical antenna, said antenna is combined with said electromagnetic wave absorbing piece, said dielectric plate, said electronic joint loop, said negative electrode lead, then plastic or rubber are filled into to be assembled as a whole body.

3. The electromagnetic radiation protection device of a mobile phone as claimed in claim 1, wherein the electromagnetic radiation protection device is an external device which can be added as a peripheral device of the original antenna of said mobile phone.

* * * * *